United States Patent [19]

McLean

[11] 3,983,625

[45] Oct. 5, 1976

[54] POWER OPERATED CAN OPENER HAVING POWER PIERCE MEANS

[75] Inventor: Robert E. McLean, Raytown, Mo.

[73] Assignee: Rival Manufacturing Company, Kansas City, Mo.

[22] Filed: May 23, 1975

[21] Appl. No.: 580,296

[52] U.S. Cl. ..... 30/4 R
[51] Int. Cl.[2] ..... B67B 7/38
[58] Field of Search ..... 30/4 R; 7/14.2 R

[56] References Cited

UNITED STATES PATENTS

| | | | |
|---|---|---|---|
| 2,806,280 | 9/1957 | Grant | 30/4 R |
| 2,896,319 | 7/1959 | Pinette | 30/4 R |
| 3,277,570 | 10/1966 | McLean | 30/4 R |
| 3,765,085 | 10/1973 | Ponczek | 30/4 R |

*Primary Examiner*—Al Lawrence Smith
*Assistant Examiner*—Gary L. Smith
*Attorney, Agent, or Firm*—Lowe, Kokjer, Kircher Wharton & Bowman

[57] ABSTRACT

A power operated can opener includes a hand lever which pivots on the can opener frame to carry a cutting element into and out of cutting position. A can feed wheel is carried on a motor driven shaft which is supported for limited vertical movement within a tapered, elliptical bore in the frame. A spring biased switch control lever is pivoted to the back of the frame in contact with the feed wheel shaft. When the cutting element is moved against the lid of a can, the downward force on the feed wheel displaces the shaft downwardly and pivots the switch control lever against the motor switch to initiate rotation of the feed wheel before the can lid is pierced by the cutting element.

9 Claims, 4 Drawing Figures

POWER OPERATED CAN OPENER HAVING POWER PIERCE MEANS

BACKGROUND AND SUMMARY OF THE INVENTION

This invention relates generally to power operated can openers and more particularly to can openers having power pierce means.

U.S. Pat. Nos. 3,018,548 and 3,313,144 disclose the power pierce concept and discuss its advantages in reducing the reactive thrust force required to penetrate the lid of a can. In this type of can opener, the motor is activated to begin feeding the can prior to its puncture by the cutting element. The subject invention is aimed primarily at reducing the required force even further by providing a unique and improved power pierce arrangement.

It is therefore an important object of the invention to provide, in a power operated can opener which includes a pivotal hand lever for moving the cutting element into and out of can cutting position, an improved power pierce mechanism which reduces the reactive thrust force required for the penetration of the end of the can by the cutting element.

Another important object of the invention is to provide in a can opener of the character described, a power pierce mechanism which is suited for use in conjunction with any kind of hand lever that is pivoted to the frame at a fixed point. In this regard, the subject can opener eliminates any shifting or rocking of the hand lever with respect to its pivot connection as could occur in a structure similar to that shown in U.S. Pat. No. 3,277,570.

An additional object of the invention is to provide a can opener of the character described in which the pivotal hand lever is maintained in a single vertical plane. In contrast to the present invention, can openers of the type shown in U.S. Pat. No. 3,345,742 require the hand lever to wobble to a certain extent relative to the can opener frame.

A further object of the invention is to provide a can opener of the character described in which the power pierce mechanism is adapted for use with hand levers that are either permanently or removably pivoted to the can opener frame. It is a significant feature of the invention that the hand lever can be secured on the frame by any type of releasable latch arrangement, including those disclosed in U.S. Pat. Nos. 3,496,635 and 3,688,400.

Still another object of the invention is to provide a can opener of the character described which is suited to incorporate cutlery sharpening or grinding means driven by the same motor that drives the can feed mechanism. Significantly, the motor is controlled by a single switch which is activated in the same manner whether or not a can is inserted in the can opener.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
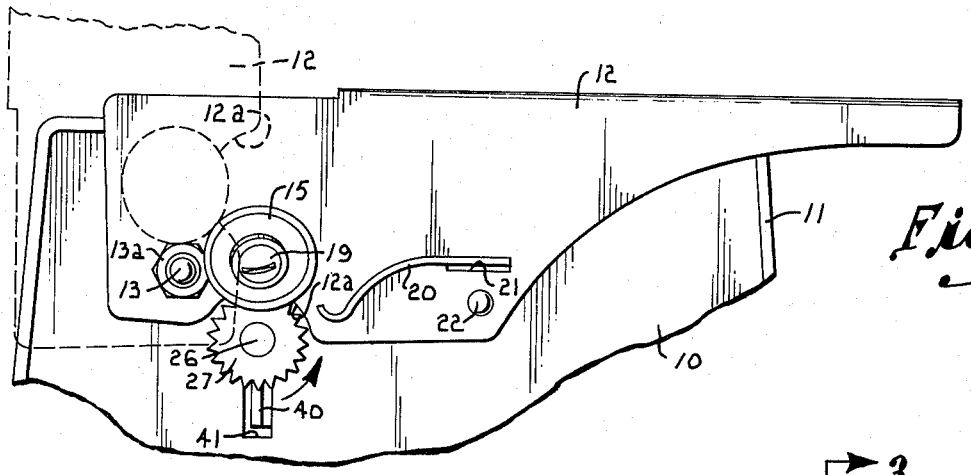
FIG. 1 is a fragmentary elevational view of the top front portion of a can opener embodying the invention, with the broken lines illustrating the hand lever pivoted upwardly to a can receiving position.

Referring now to the drawing in more detail, reference numeral 10 designates the upright frame of the can opener which cooperates with a box-like casing 11 to support and house the operating components. A hand lever 12 is preferably pivoted to frame 10 in the same manner as shown in U.S. Pat. Nos. 3,277,570 and 3,345,742. Accordingly, a cylindrical can guide 13 extends forwardly from lever 12 and includes a hexagonal portion 13*a* which contacts the forward surface of the hand lever. As disclosed in the aforementioned patents, a threaded portion (not shown) of can guide 13 extends rearwardly from hand lever 12 through a bore formed in a boss 14 located on the rear surface of frame 10. An elongated nut (not shown) is threaded onto the rearward end of can guide 13 with a cylindrical journal portion of this elongate nut located within the bore of boss 14 to facilitate the pivoting of the lever. Finally, a jam nut (also not shown) is threaded onto the extreme rearward end of can guide 13 to complete the pivotal connection of hand lever 12 to the frame. It is contemplated that the pivotal attachment of lever 12 may be accomplished in an alternative fashion, such as by the latch arrangements shown in U.S. Pat. Nos. 3,496,635 and 3,688,400, as well as by any other appropriate means.

An area on the bottom edge of lever 12 is recessed upwardly to provide a generally semicircular contoured portion 12*a* (FIG. 1). The free end of lever 12 includes a rearwardly turned flange 12*b* (FIG. 2) on its top edge. As best illustrated in the broken line view of FIG. 2, flange 12*b* contacts the top of the can opener to limit the downward movement of lever 12.

A cutter wheel 15 is journaled for rotation on a stud 16 which is anchored to a compound angled boss 17 of lever 12, preferably by a hot heading process. A compression spring 18 is coiled around stud 16 with one end of the spring bearing against a flange 16*a* of the stud and the other end of the spring pushing outwardly on cutter wheel 15. Spring 18 permits limited wobble movement of the cutter wheel on stud 16. A washer head screw 19 fastens cutter wheel 15 on the end of stud 16.

A conventional resilient can guide 20 is also carried on lever 12. A portion of can guide 20 extends through an opening 21 in the lever in the usual manner, and a rivet 22 secures can guide 20 to the lever.

Figure 3:
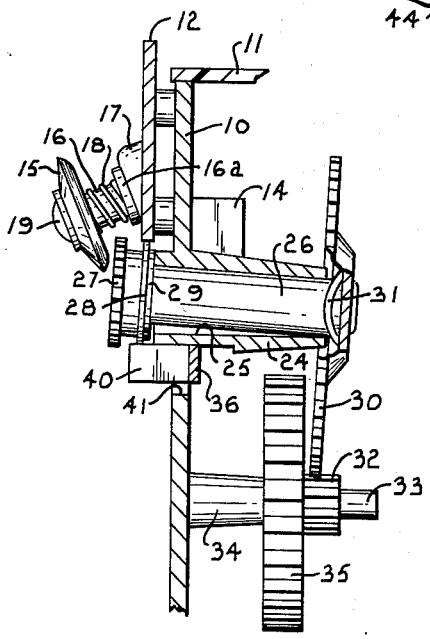
FIG. 3 is a cross-sectional view taken generally along line 3—3 of FIG. 2 in the direction of the arrows and showing the can feed wheel and its drive shaft in their upper positions.
Figure 4:
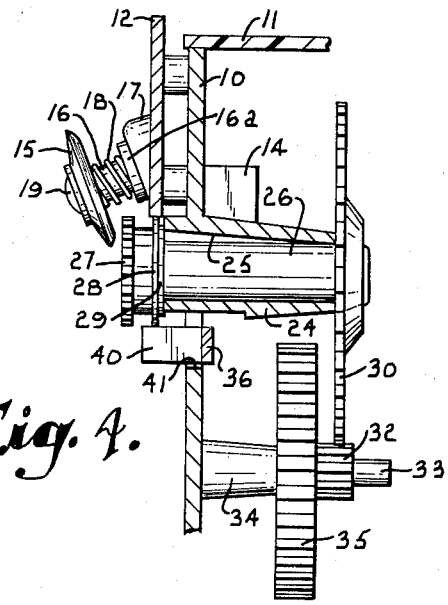
FIG. 4 is a cross-sectional view similar to FIG. 3, but showing the can feed wheel and its drive shaft in their lower positions.

Referring to FIGS. 3 and 4, frame 10 includes a generally cylindrical boss 24 which projects a short distance forwardly of the frame and a greater distance rearwardly thereof. Boss 24 has a bore 25 in which a cylindrical shaft 26 is supported for rotation. The extreme rearward portion of bore 25 is circular in cross-section and is substantially the same size as the diameter of shaft 26 (except for a few thousandths of an inch clearance). However, as the bore extends forwardly, it gradually enlarges in an elliptical shape with the major axis of the ellipse being oriented vertically. The lateral dimension of bore 25 remains constant and is approximately equal to the diameter of shaft 26 through the length of the bore. Accordingly, shaft 26 is able to move upwardly and downwardly within bore 25 between the positions shown in FIGS. 3 and 4, although the shaft is not able to move horizontally due to the size and configuration of the bore.

Shaft 26 is reduced in diameter and threaded at its forward end to receive a serrated feed wheel 27. A hardened flat washer 28 is fitted over shaft 26 between feed wheel 27 and the forward end of boss 24, while a shim washer 29 is interposed between boss 24 and washer 28 to assure that the latter washer is maintained in the same plane as lever 12 and also to achieve the desired spacing between the overlapping portions of cutter wheel 15 and feed wheel 27.

A gear 30 is swaged on the rearward end of shaft 26 which further has a curved spring washer 31 (FIG. 3) telescoped over same (shaft 26) between the rearward end of boss 24 and gear 30 such that shim washer 29 is continuously urged to seat against the forward end of boss 24. Gear 30 is driven by a pinion 32 which is journaled on a shaft 33 supported in a boss 34 of frame 10. A larger gear 35 is pressed on pinion 32, and gear 35 is in turn driven by another pinion (not shown) which is preferably carried on the drive shaft 35*a* of a conventional electric motor M. Shaft 26 and feed wheel 27 are thus driven by the motor through the reduction gearing arrangement.

Figure 2:
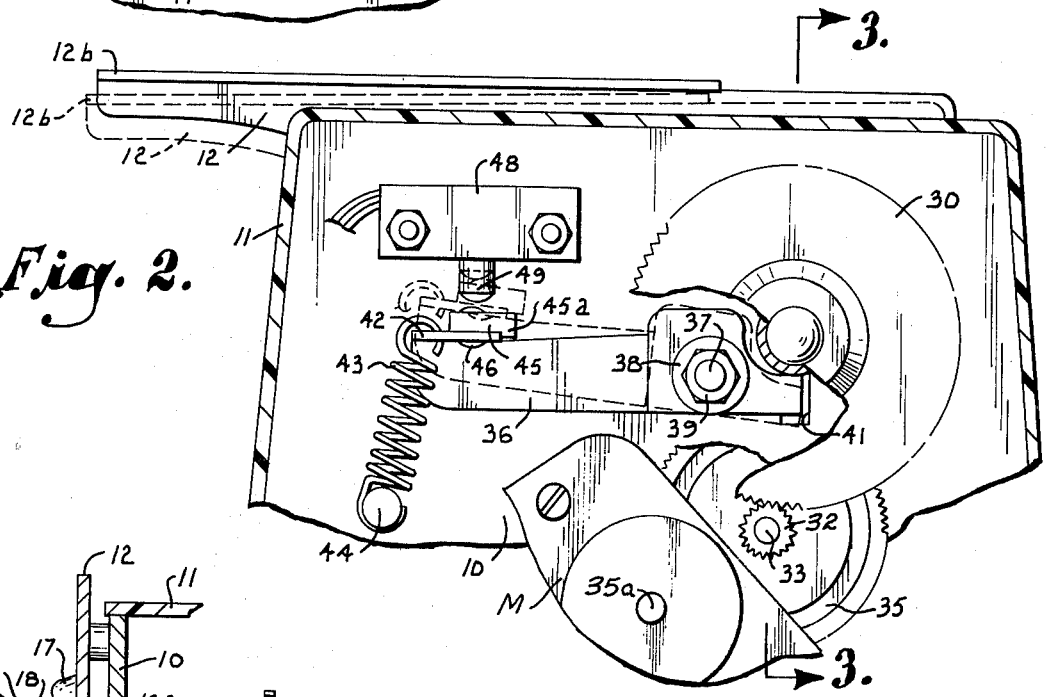
FIG. 2 is a fragmentary rear elevational view of the can opener shown in FIG. 1, with the casing and a portion of the large gear broken away for clarity and the broken lines illustrating movement of the hand lever and switch control lever to depress the switch plunger.

Referring to FIG. 2, a switch control lever 36 is pivoted to a boss on the back side of frame 10 by a bolt 37, a washer 38 and a nut 39. The head of bolt 37 is located within a hexagonal recess (not shown) of frame 10. The right end of lever 36 (as viewed in FIG. 2) includes a tang portion 40 which extends forwardly through a slot 41 formed in frame 10. The underside of washer 28 is engaged by tang portion 40. The portion of lever 36 located to the left of pivot bolt 37 (as viewed in FIG. 2) is offset rearwardly somewhat from the frame. An ear 42 extends rearwardly from the left end of lever 36 and is provided with an aperture in which the top end of a tension spring 43 is hooked. The bottom end of spring 43 is hooked on a boss 44 that extends rearwardly from frame 10. Spring 43 thus urges lever 36 counterclockwise (as viewed from the rear) such that tang portion 40 acts against washer 28 to maintain shaft 26 and feed wheel 27 in their upper positions, as shown in FIG. 3, when a can is not engaged in the can opener.

An insulator 45 is secured to the top of ear 42 by a rivet 46. Insulator 45 includes a downwardly projecting rib 45*a* which engages the side of ear 42 to prevent rotation of the insulator.

A switch 48, which is wired in series with the can opener motor (not shown), is mounted to the back side of frame 10 at a location directly above ear 42 and insulator 45. Switch 48 is of the normally open type and includes a plunger 49 which may be depressed to close the switch and energize the motor. The action of spring 43 normally maintains insulator 45 below plunger 49. It is contemplated that there are other types of normally open switches which are equally suited for use with the invention.

The can opener is adapted to incorporate cutlery sharpening means of any desired type (not shown). The same motor which drives feed wheel 27 also operates to drive the conventional grinding wheel (also not shown) of the cutlery sharpener, and the depression of plunger 49 will therefore cause the grinding wheel to rotate.

When the can opener is not in use, spring 43 urges the left end of switch control lever 36 downwardly to the position shown in solid lines in FIG. 2. Tang portion 40 of the switch control lever is thus urged upwardly to bear against washer 28, and the tension of spring 43 is sufficient to maintain hand lever 12 and shaft 26 in the positions shown in FIG. 3. In this position, shaft 26 seats upwardly in bore 25, and the shaft is preferably cocked at an angle approximately 1 ½° from its horizontal operating position.

In operation, hand lever 12 is swung upwardly about the axis of can guide 13 to separate cutter wheel 15 from feed wheel 27. The can is then inserted with its rim or flange on top of feed wheel 27 and beneath can guide 13. As lever 12 is swung downwardly to open the can, the periphery of cutter wheel 15 first engages (but does not penetrate) the can lid before the lever reaches the solid line position of FIG. 2. Further downward pivoting of lever 12 to the extreme broken line position of FIG. 2 causes the rim of the can to push feed wheel 27 downwardly against the force of spring 43. Shaft 26 is moved along with feed wheel 27 until the shaft seats downwardly in bore 25 in the position shown in FIG. 4. The downward movement of shaft 26 carries washer 28 downwardly against tang portion 40, which pivots switch control lever 36 to the broken line position of FIG. 2. The upward movement of insulator 45 depresses plunger 49 to start the motor and initiate rotation of feed wheel 27 prior to the piercing of the can lid. Resilient can guide 20, in cooperation with can guide 13, pushes downwardly on the rim of the can to insure proper traction of feed wheel 27 against the underside of the can rim as the can is being opened. In this manner, feed wheel 27 advances the can relative to cutter wheel 15 as the cutter wheel pierces the can lid. The resultant power piercing of the can requires much less force on hand lever 12 than in the situation where the can is not being fed as it is pierced. After the can lid has been completely sheared, lever 12 is swung upwardly to permit removal of the can from the can opener.

To operate the cutlery sharpening means alone, lever 12 is swung to its extreme lower position shown in broken lines in FIG. 2. This moves the contoured portion 12a of the lever downwardly against the top of washer 28 and moves shaft 26 to the lower position shown in FIG. 4. Switch control lever 36 is thereby pivoted to move insulator 45 against plunger 49 in the manner previously related. The energized motor will remain on until the free end of lever 12 is released, at which time spring 43 will pull insulator 45 away from plunger 49 to stop the motor.

As previously indicated, shaft 26 is preferably cocked at an angle of 1 ½° from horizontal when in the position shown in FIG. 3. Although this cocking is not sufficient to adversely effect the driving of gear 30 by pinion 32, it is pointed out that shaft 26 is horizontal or parallel to shaft 33 whenever the gears are under load, as when a can is being opened or the cutlery sharpening means is being operated. Accordingly, the proper interaction of the gears is assured at all times.

Whenever a can is not engaged in the can opener and the free end of lever 12 seats downwardly on the case of the can opener (such as when the cutlery grinding means is being operated), the forward end of shaft 26 will be a few thousandths of an inch above its normal seat in bore 25.

From the foregoing, it will be seen that this invention is one well adapted to attain all of the ends and objects herein set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. A can opener comprising:

a frame;

a rotary can feed wheel for receiving the rim of a can thereon;

a shaft carrying said can feed wheel thereon;

means defining an opening greater in size than said shaft and extending generally horizontally in said frame, said shaft being supported for rotation in said opening and movable therein in a generally vertical plane from an upper position to a lower position in response to downward force on said feed wheel;

a hand lever supported on said frame for movement relative thereto;

a cutter member carried on said hand lever and movable therewith into and out of cutting relationship with respect to said feed wheel;

a motor drivingly coupled to said shaft to effect rotation of said feed wheel; and motor control means operable to energize said motor upon movement of said shaft to its lower position as said cutter member is moved against the lid of an inserted can.

2. A can opener as set forth in claim 1, wherein said motor control means includes:

a normally open switch for said motor; and a switch control lever pivotally supported on said frame and having a portion engaging said shaft, said switch control lever being pivoted to effect closing of said switch and energization of said motor upon movement of said shaft to its lower position.

3. A can opener as set forth in claim 2, including yieldable means urging said switch control lever away from said switch and biasing said shaft toward its upper position.

4. A can opener as set forth in claim 1, wherein said opening defines the general shape of an ellipse, the major axis of the ellipse being oriented vertically and gradually increasing in length as said opening extends toward said feed wheel, the minor axis of the ellipse being substantially constant in length and corresponding to the diameter of said shaft to confine the movement of said shaft to a vertical plane.

5. A can opener as set forth in claim 4, wherein said motor control means includes a normally open switch for said motor and a switch control lever pivotally supported on said frame and having a portion engaging said shaft, said shaft pivoting said switch control lever to close said switch and energize said motor upon movement of said feed wheel to its lower position.

6. A can opener as set forth in claim 5, including yieldable means urging said switch control lever away from said switch and biasing said feed wheel toward its upper position.

7. A can opener as set forth in claim 1, wherein said hand lever is supported on said frame for pivotal movement about a pin member offset from said cutter member, said hand lever including a can guide extending therefrom in coaxial relationship with said pin member to contact the rim of a can inserted on said feed wheel during movement of said cutter member toward said feed wheel.

8. A can opener comprising:

a frame;

a rotary can feed wheel for receiving the rim of a can;

means supporting said feed wheel for rotation on said frame and for substantially free movement thereon restricted to a generally vertical direction from an upper position to a lower position in response to downward force on said feed wheel;

a hand lever supported on said frame for movement relative thereto;

a cutter member carried on said hand lever and movable therewith into and out of cutting relationship with respect to said feed wheel;

a motor drivingly coupled to said feed wheel to effect rotation of same; and motor control means operable to energize said motor upon movement of said feed wheel to its lower position as said cutter member is moved against the lid of an inserted can.

9. A can opener comprising:

a frame;

a rotary can feed wheel for receiving the rim of a can;

a shaft carrying said feed wheel thereon;

means for rotatably supporting said shaft on said frame, said shaft supporting means permitting generally vertical movement of said feed wheel from an upper position to a lower position in response to downward force thereon;

a hand lever supported on said frame for movement relative thereto;

a cutter member carried on said hand lever and movable therewith into and out of cutting relationship with respect to said feed wheel;

a motor drivingly coupled to said shaft to effect rotation of said feed wheel; and motor control means for energizing and deenergizing said motor, said shaft engaging said motor control means to energize said motor in response to movement of said feed wheel to its lower position as said cutter member is moved against the lid of an inserted can.

* * * * *